US012262830B1

(12) United States Patent
Xu

(10) Patent No.: US 12,262,830 B1
(45) Date of Patent: Apr. 1, 2025

(54) SUPPORTING AND LOCKING STRUCTURE FOR CLOTH FRAME

(71) Applicant: Jinhua Peinuo Home Furnishings Co., Ltd., Zhejiang (CN)

(72) Inventor: Xianqin Xu, Zhejiang (CN)

(73) Assignee: Jinhua Peinuo Home Furnishings Co., Ltd., Zhejiang (CN)

( * ) Notice: Subject to any disclaimer, the term of this patent is extended or adjusted under 35 U.S.C. 154(b) by 0 days.

(21) Appl. No.: 18/922,423

(22) Filed: Oct. 22, 2024

(30) Foreign Application Priority Data

May 17, 2024 (CN) ..... 202421092533.2

(51) Int. Cl.
*A47G 29/08* (2006.01)

(52) U.S. Cl.
CPC ..... *A47G 29/08* (2013.01)

(58) Field of Classification Search
CPC ..... A47G 29/00; A47G 29/08
USPC ..... 206/278, 527
See application file for complete search history.

(56) References Cited

U.S. PATENT DOCUMENTS 4,019,674 A * 4/1977 Ikelheimer ..... B65D 15/08 229/5.5
7,699,212 B2 * 4/2010 Turvey ..... B65D 21/0219 206/508
9,961,975 B1 * 5/2018 Tong ..... A45C 13/103
11,849,874 B2 12/2023 Li et al.
2006/0157358 A1 * 7/2006 Heidel ..... D06F 95/002 206/278
2013/0284734 A1 * 10/2013 Huang ..... B65D 11/22 220/9.4
2015/0114281 A1 * 4/2015 Bartuli ..... G09F 13/16 116/63 T
2015/0296947 A1 * 10/2015 Berglund ..... B65D 33/14 53/415
2022/0165186 A1 * 5/2022 Colpaert ..... G09F 15/0025
2023/0227087 A1 * 7/2023 Sun ..... B62B 3/025 280/42

* cited by examiner

*Primary Examiner* — Jacob K Ackun
(74) *Attorney, Agent, or Firm* — Ricky Lam

(57) ABSTRACT

The present utility model discloses a supporting and locking structure for a cloth frame, which pertains to the technical field of articles for daily use. It comprises a hard base, a cloth frame, a positioning frame, supporting structures, a flip cover, and lifting openings. The cloth frame is fixed on the hard base. The positioning frame is fixed at a cloth frame opening of the cloth frame. Four supporting structures are arranged between the hard base and the positioning frame. The flip cover is sewn on one side on the cloth frame. The lifting openings are arranged on left and right ends of the cloth frame. It is featured with reasonable structure design, beautiful appearance, novel and unique shape, simple operation, convenient utilization, and glue-free fixation. As clamping is adopted as the fixing manner, it is not only simple in production process, but also environmentally friendly for consumers to use. As the three-dimensional support is realized through the supporting structures, it is flatter and more stereoscopic when articles are placed therein. As the lifting openings are arranged on the left and right sides of the cloth frame, it is convenient for people to take, which meets consumers' usage needs.

5 Claims, 12 Drawing Sheets

SUPPORTING AND LOCKING STRUCTURE FOR CLOTH FRAME

CLAIMS OF PRIORITY

This patent application claims priority from:

(1) CN utility model patent application number is 202421092533.2 with a filing date of May 17, 2024 and DAS code of F871.

TECHNICAL FIELD

The present utility model relates to a supporting and locking structure for a cloth frame, and pertains to the technical field of articles for daily use.

BACKGROUND

Cloth frames are mainly used for accommodating and storing articles. As spring goes and autumn comes, storage cloth frames always lie idle in this or that season. However, the existing storage cloth frames cannot be folded, and therefore take up a lot of space. There is an urgent need for a cloth frame that is foldable and can realize three-dimensional support when in use. The foldable cloth frame structure on the market has a complex design, with a cloth frame opening and a hard positioning frame stuck and fixed together by glue. This structure neither is environmentally friendly enough nor meets people's usage needs.

SUMMARY

Given the above problems, the technical problem to be solved by the present utility model is to provide a supporting and locking structure for a cloth frame.

A supporting and locking structure for a cloth frame in the present utility model comprises a hard base, a cloth frame, a positioning frame, supporting structures, a flip cover, and lifting openings. The cloth frame is fixed on the hard base. The positioning frame is fixed at a cloth frame opening of the cloth frame. Four supporting structures are arranged between the hard base and the positioning frame. The flip cover is sewn on one side on the cloth frame. The lifting openings are arranged on left and right ends of the cloth frame.

As a preferred option, the cloth frame is designed with a soft structure, with loop fasteners sewn at four corners on an upper inner side of the cloth frame. Protective belts are sewn at four corners that are located on the hard base under the cloth frame. Hook fasteners are arranged on one end of the protective belts and stuck to the four loop fasteners on the upper inner side of the cloth frame.

As a preferred option, the positioning frame consists of a positioning subframe and a positioning parent frame. A locking convex edge on an outer side of the positioning subframe is fixedly connected to edges of the cloth frame opening of the cloth frame through a sewing machine. A plurality of locking grooves are arranged on a convex wall on an inner side of the positioning subframe. Locking barbs are fixed in the locking grooves, and fixedly connected to a plurality of positioning grooves on an inner side at a bottom portion of the positioning parent frame. The locking convex edge on the outer side of the positioning subframe is clamped in the locking grooves at a lower portion of the positioning parent frame, while the locking barbs are clamped and fixed in the positioning grooves. A flip cover positioning groove is arranged on the positioning parent frame. When the flip cover is locked, it is just clamped in the flip cover positioning groove.

As a preferred option, the supporting structure consists of a first supporting leg, a second supporting leg, a first protective cover, a second protective cover, a positioning sleeve, and an elastic band. The first supporting leg and the second supporting leg are designed with hollow structures. The first supporting leg and the second supporting leg have supporting portions, on which the first protective sleeve and the second protective sleeve are fixed. The positioning sleeve is fixed on the first supporting leg. The elastic band is fixed between the first supporting leg and the second supporting leg. The first supporting leg and the second supporting leg can be folded and stored. The elastic band plays a folding role. As the first supporting leg and the second supporting leg are pulled apart, they can be pulled by means of the elasticity of the elastic band to reset and combine with each other, so that the second supporting leg is clamped in the positioning sleeve, and the first supporting leg and the second supporting leg are fixed in the shape of I.

As a preferred option, the supporting structure has an upper end and a lower end that abut against the hard base on an inner side of the cloth frame and a positioning frame bottom of the positioning subframe through the first protective sleeve and the second protective sleeve, respectively.

The present utility model has the following beneficial effects: it is featured with reasonable structure design, beautiful appearance, novel and unique shape, simple operation, convenient utilization, and glue-free fixation; as clamping is adopted as the fixing manner, it is not only simple in production process, but also environmentally friendly for consumers to use; as the three-dimensional support is realized through the supporting structures, it is flatter and more stereoscopic when articles are placed therein; as the lifting openings are arranged on the left and right sides of the cloth frame, it is convenient for people to take, which meets consumers' usage needs.

BRIEF DESCRIPTION OF DRAWINGS

To provide an easy-to-understand explanation, the present utility model is described in detail through the following specific embodiments and drawings.

1. hard base; 2. cloth frame; 21. loop fastener; 22. protective belt; 221. hook fastener; 3. positioning frame; 31. positioning subframe; 311. locking convex edge; 312. locking groove; 313. locking barb; 314. positioning frame bottom; 32. positioning parent frame; 321. positioning groove; 322. locking groove; 323. flip cover positioning groove; 4. supporting structure; 41. first supporting leg; 42. second supporting leg; 43. first protective sleeve; 44. second protective sleeve; 45. positioning sleeve; 46. elastic band; 5. flip cover; 6. lifting opening.

DESCRIPTION OF EMBODIMENTS

Figure 1:
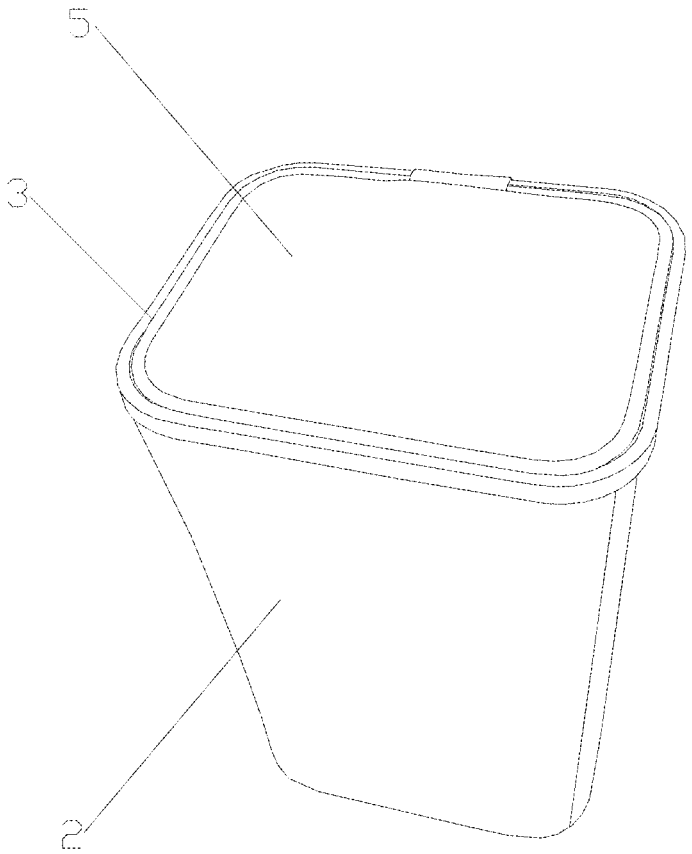
FIG. 1 is a structure diagram of the present utility model.
Figure 2:
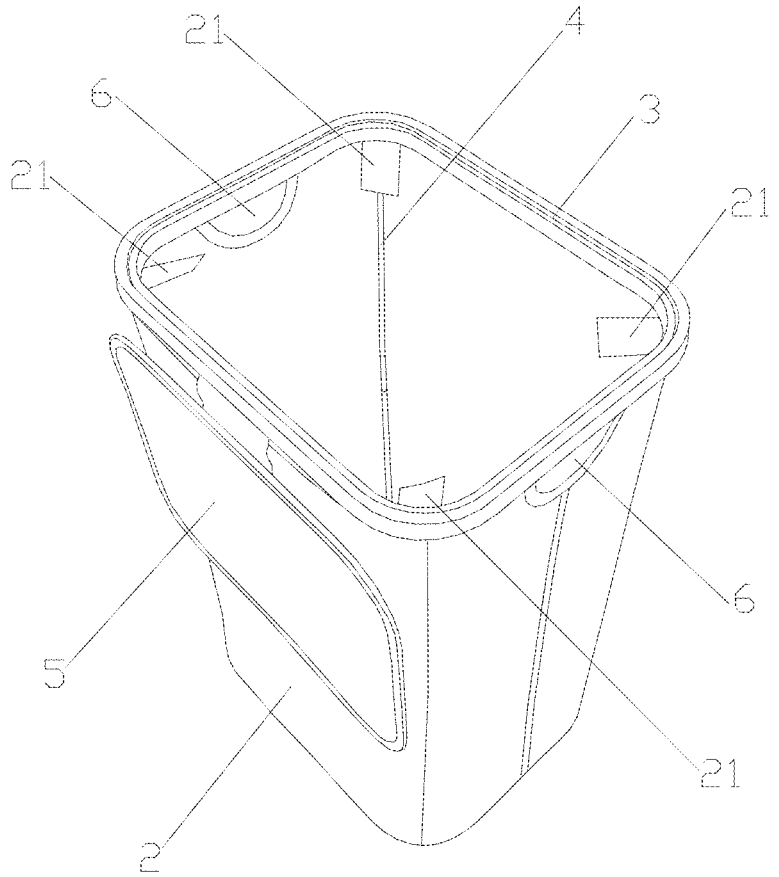
FIG. 2 is a structure diagram of the present utility model after the flip cover is opened.
Figure 3:
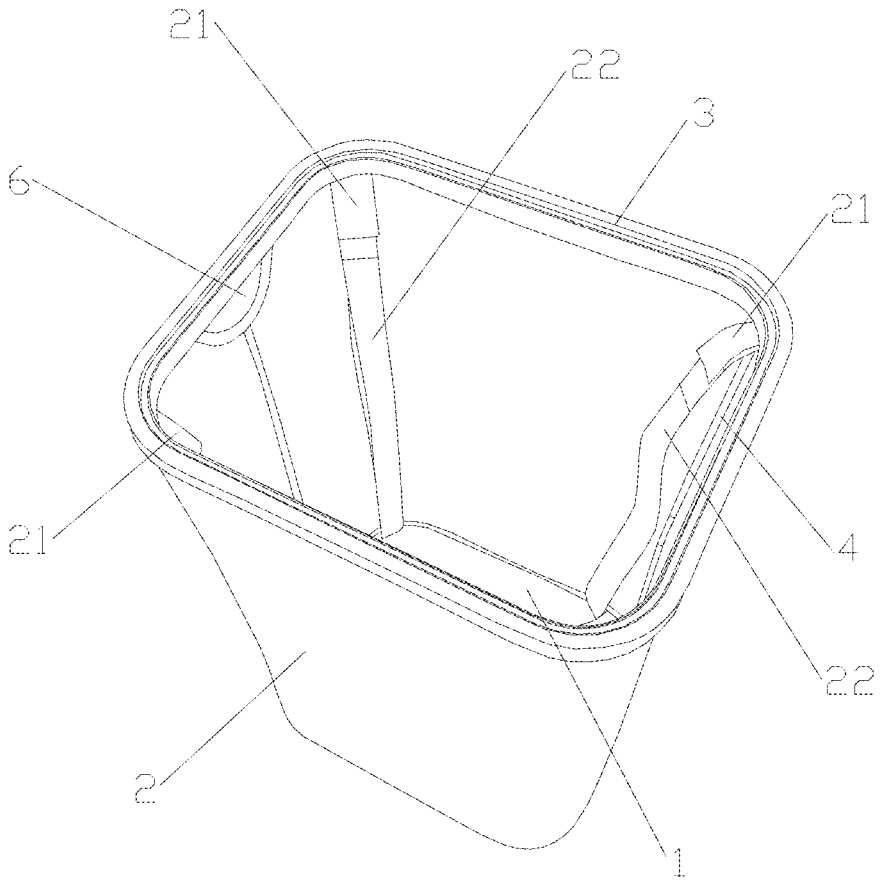
FIG. 3 is an internal structure diagram of the present utility model.
Figure 4:
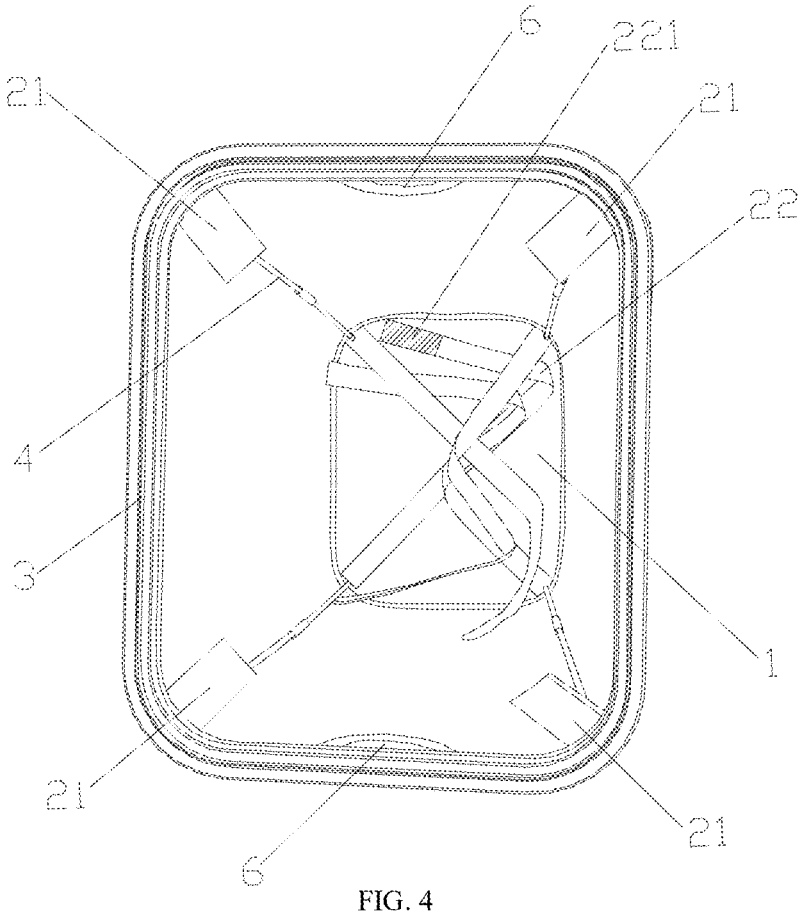
FIG. 4 is a mounting structure diagram of the protective belts in the present utility model.
Figure 5:
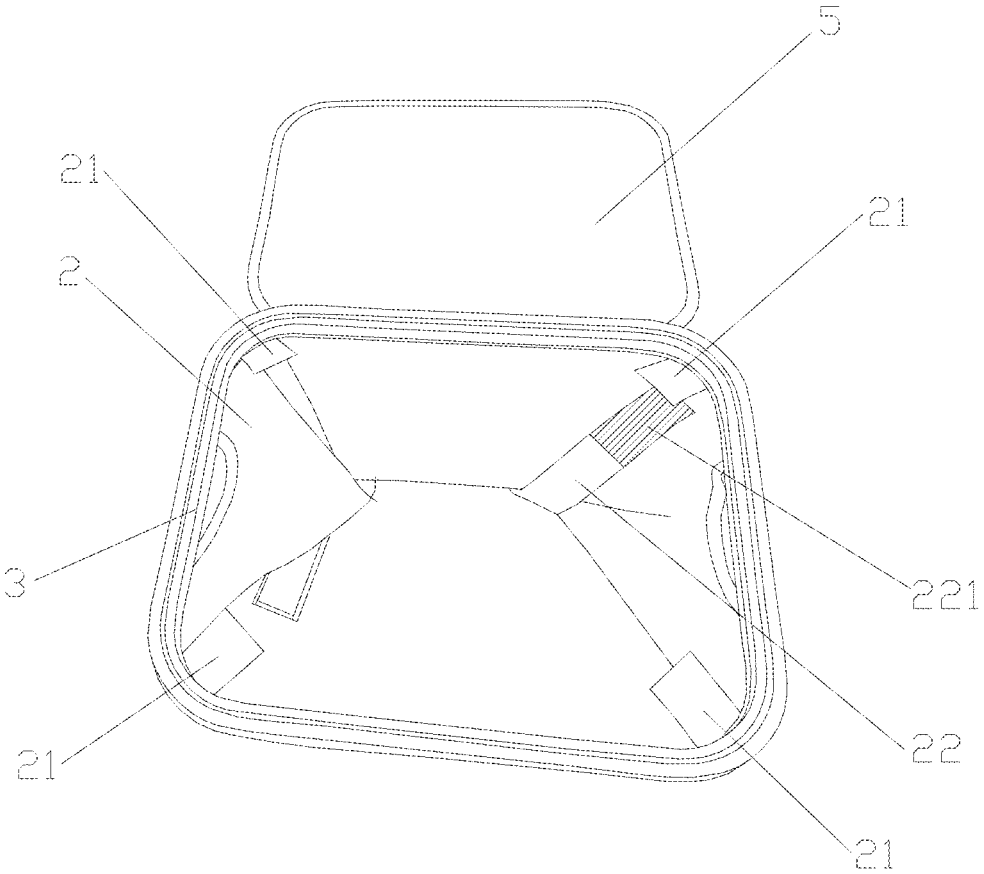
FIG. 5 is a structure diagram of the present utility model in a folded state.
Figure 6:
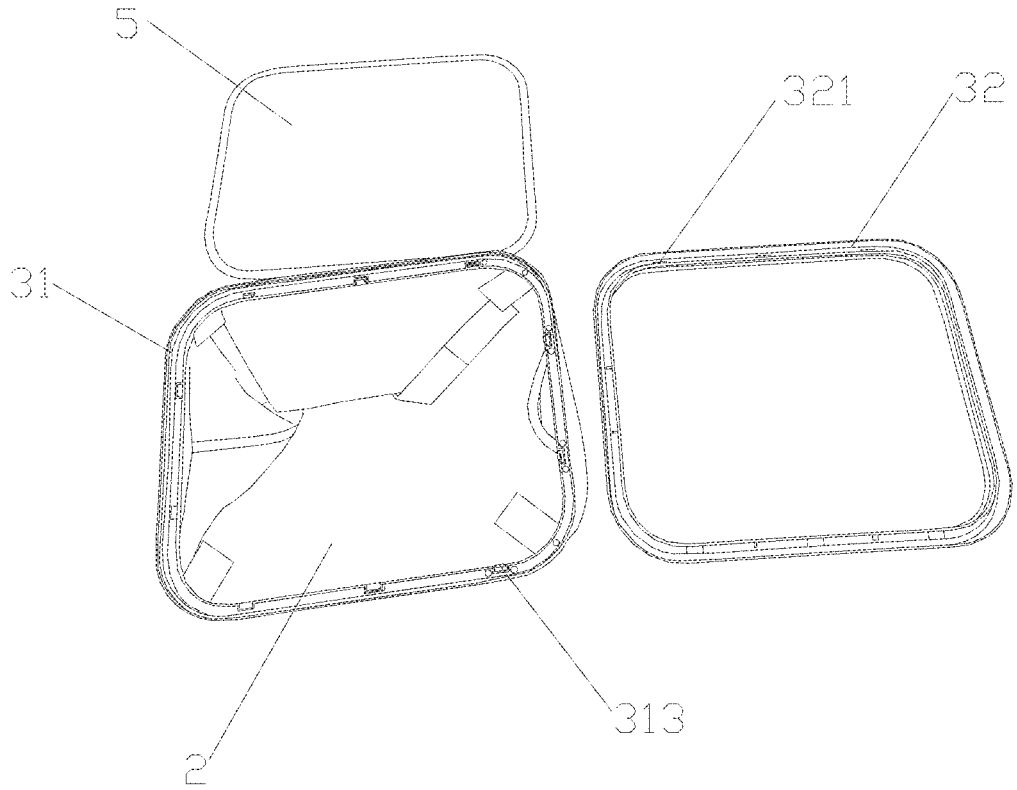
FIG. 6 is a partial exploded view of FIG. 5.
Figure 7:
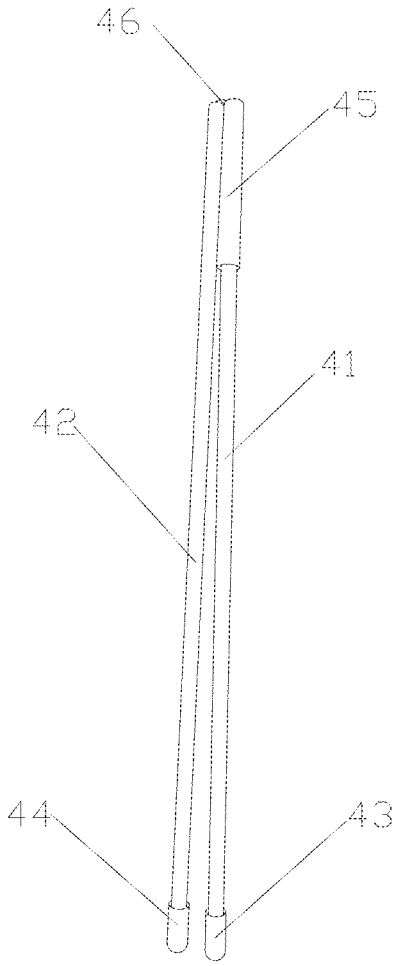
FIG. 7 is a structure diagram of the supporting structure in the present utility model.
Figure 8:
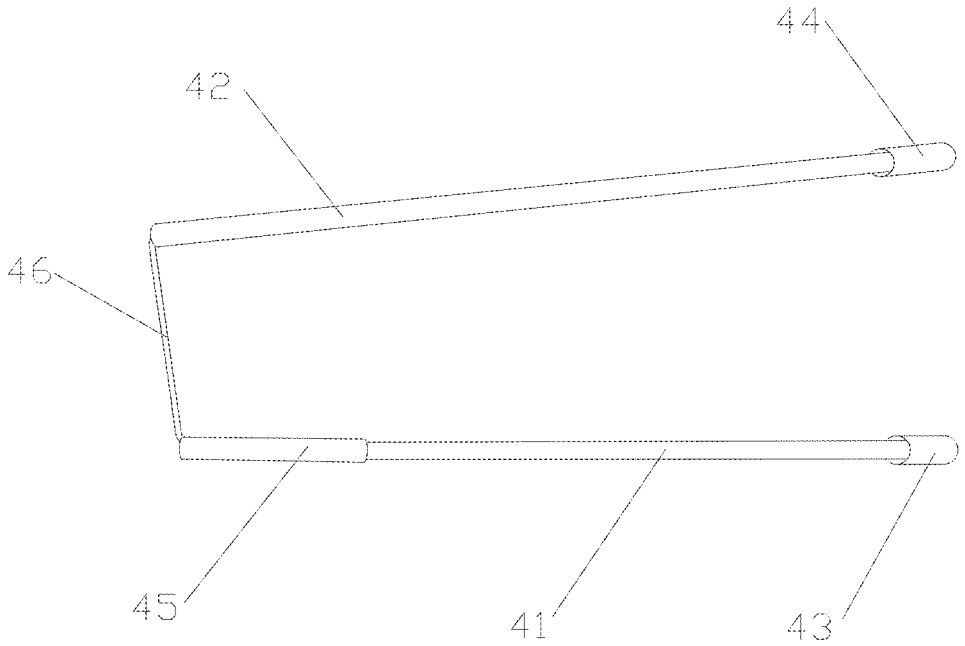
FIG. 8 is a structure diagram of the present utility model after the supporting structure is pulled apart.
Figure 9:
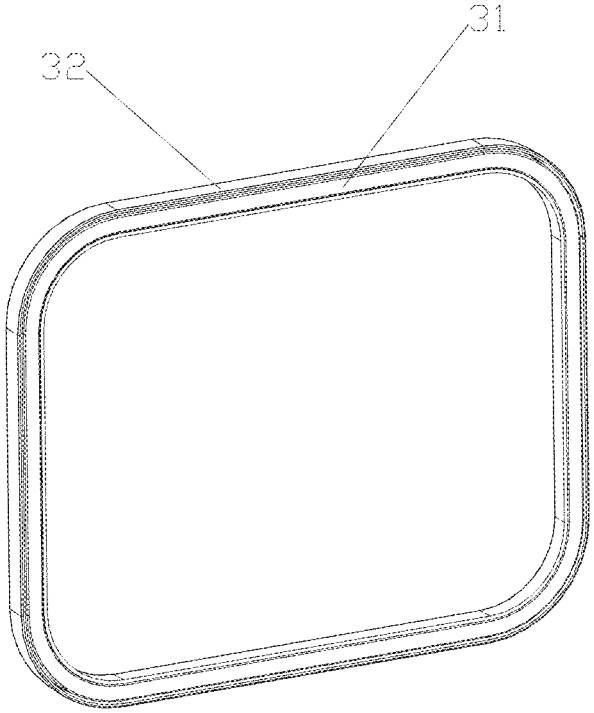
FIG. 9 is a structure diagram of the positioning frame in the present utility model.
Figure 10:
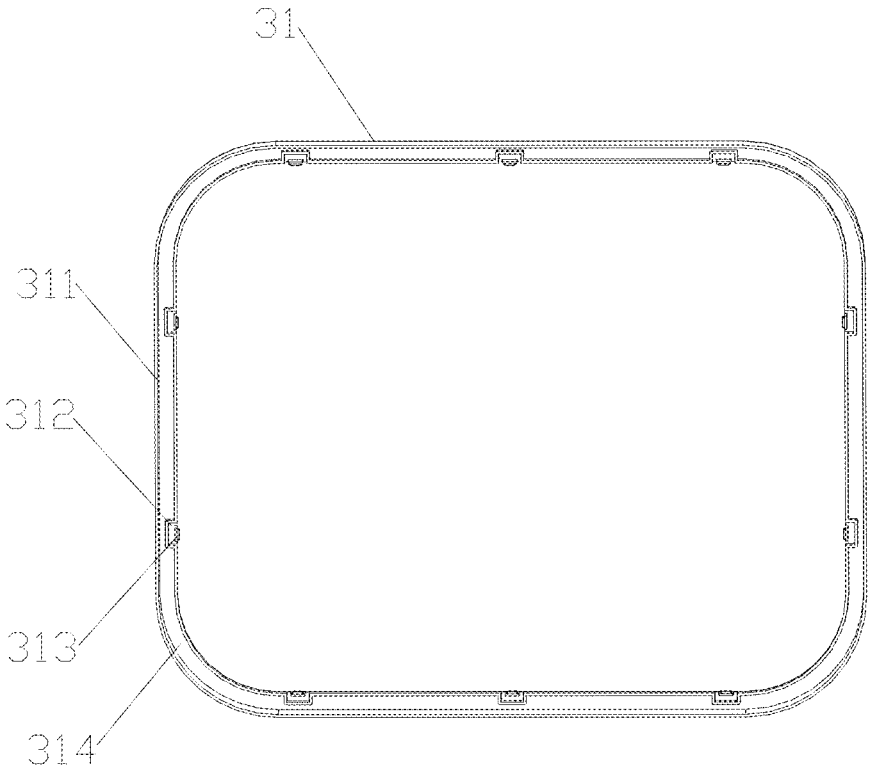
FIG. 10 is a structure diagram of the positioning subframe in the present utility model.
Figure 11:
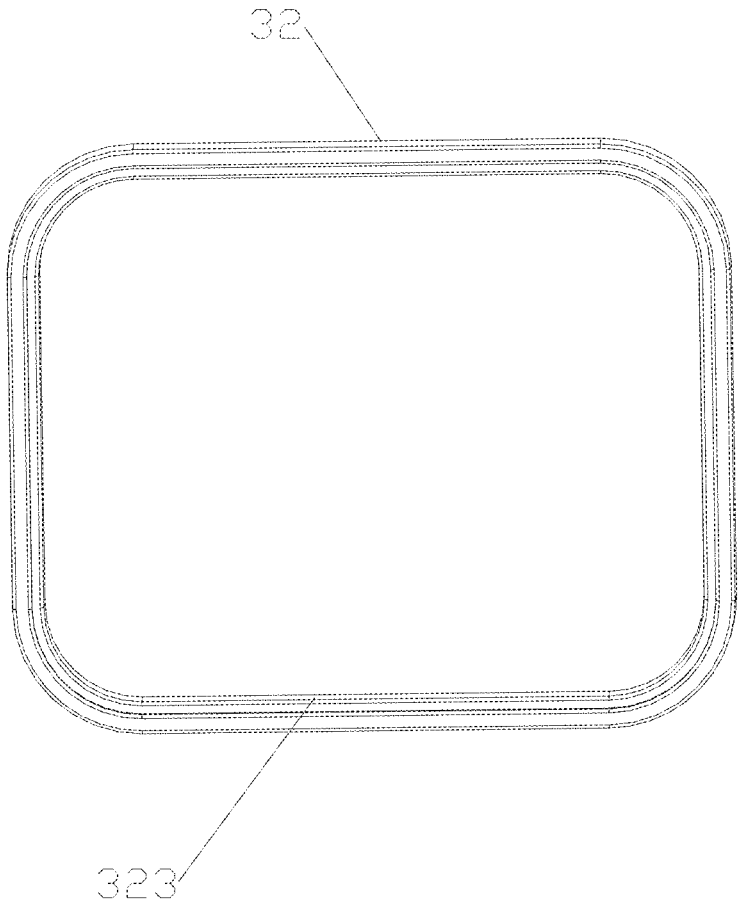
FIG. 11 is a structure diagram of the positioning parent frame in the present utility model.
Figure 12:
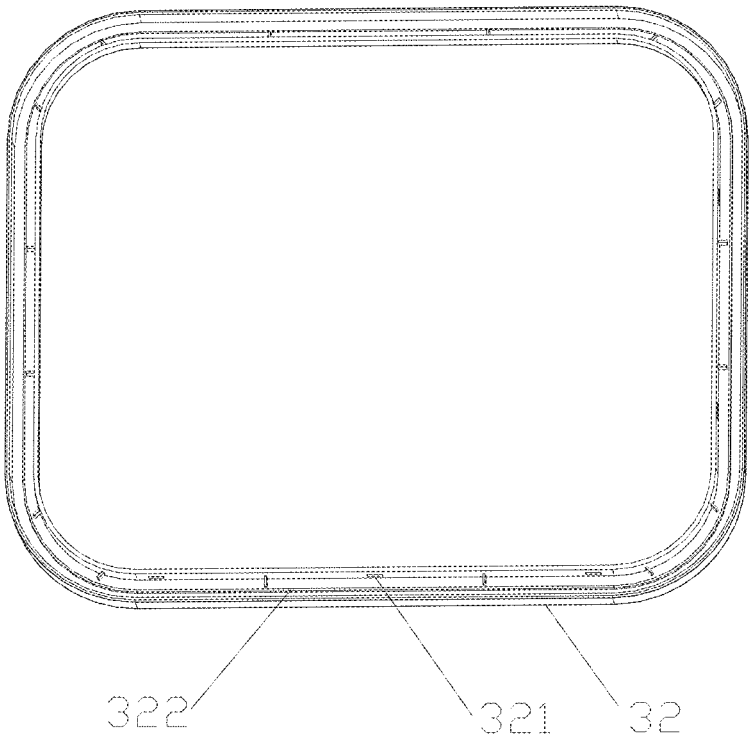
FIG. 12 is an internal structure diagram of the positioning parent frame in the present utility model.

As shown in FIGS. 1-12, the present specific manner of implementation adopts the following technical solution: it comprises a hard base 1, a cloth frame 2, a positioning frame 3, supporting structures 4, a flip cover 5, and lifting openings 6. The cloth frame 2 is fixed on the hard base 1. The positioning frame 3 is fixed at a cloth frame opening of the cloth frame 2. Four supporting structures 4 are arranged between the hard base 1 and the positioning frame 3, which makes it more stereoscopic when unfolded. The flip cover 5 is sewn on one side on the cloth frame 2. The lifting openings 6 are arranged on left and right ends of the cloth frame 2.

The cloth frame 2 is designed with a soft structure, can be unfolded to accommodate articles, and therefore becomes flatter and more stereoscopic. Loop fasteners 21 are sewn at four corners on an upper inner side of the cloth frame 2. Protective belts 22 are sewn at four corners that are located on the hard base 1 under the cloth frame 2. Hook fasteners 221 are arranged on one end of the protective belts 22 and stuck to the four loop fasteners 21 on the upper inner side of the cloth frame 2.

The positioning frame 3 consists of a positioning subframe 31 and a positioning parent frame 32. A locking convex edge 311 on an outer side of the positioning subframe 31 is fixedly connected to edges of the cloth frame opening of the cloth frame 2 through a sewing machine. A plurality of locking grooves 312 are arranged on a convex wall on an inner side of the positioning subframe 31. Locking barbs 313 are fixed in the locking grooves 312, and fixedly connected to a plurality of positioning grooves 321 on an inner side at a bottom portion of the positioning parent frame 32. The locking convex edge 311 on the outer side of the positioning subframe 31 is clamped in the locking grooves 322 at a lower portion of the positioning parent frame 32, while the locking barbs 313 are clamped and fixed in the positioning grooves 321. A flip cover positioning groove 323 is arranged on the positioning parent frame 32. When the flip cover 5 is locked, it is just clamped in the flip cover positioning groove 323.

The supporting structure 4 consists of a first supporting leg 41, a second supporting leg 42, a first protective cover 43, a second protective cover 44, a positioning sleeve 45, and an elastic band 46. The first supporting leg 41 and the second supporting leg 42 are designed with hollow structures. The first supporting leg 41 and the second supporting leg 42 have supporting portions, on which the first protective sleeve 43 and the second protective sleeve 44 are fixed. The positioning sleeve 45 is fixed on the first supporting leg 41. The elastic band 46 is fixed between the first supporting leg 41 and the second supporting leg 42. The first supporting leg 41 and the second supporting leg 42 can be folded for storage. The elastic band 46 plays a folding role. As the first supporting leg 41 and the second supporting leg 42 are pulled apart, they can be pulled by means of the elasticity of the elastic band 46 to reset and combine with each other, so that the second supporting leg 42 is clamped in the positioning sleeve 45, and the first supporting leg 41 and the second supporting leg 42 are fixed in the shape of I.

The supporting structure 4 has an upper end and a lower end that abut against the hard base 1 on the inner side of the cloth frame 2 and a positioning frame bottom 314 of the positioning subframe 31 through the first protective sleeve 43 and the second protective sleeve 44, respectively.

The present specific manner of implementation is featured with reasonable structure design, beautiful appearance, novel and unique shape, simple operation, convenient utilization, and glue-free fixation. As clamping is adopted as the fixing manner, it is not only simple in production process, but also environmentally friendly for consumers to use. As the three-dimensional support is realized through the supporting structures, it is flatter and more stereoscopic when articles are placed therein. As the lifting openings are arranged on the left and right sides of the cloth frame, it is convenient for people to take, which meets consumers' usage needs.

The above content shows and describes the basic principles, main features, and advantages of the present utility model. Persons skilled in the art should understand that the present utility model is not limited by the above embodiments. The illustrations in the above embodiments and in the description only explain the principles of the present utility model. Without departing from the spirit and scope of the present utility model, various changes and improvements will be made to the present utility model. All these changes and improvements fall within the scope of the present utility model as claimed. The scope of protection as claimed by the present utility model is determined by the attached claims and equivalents thereof.

The invention claimed is:

1. A supporting and locking structure for a cloth frame, comprising a hard base (1), a cloth frame (2), a positioning frame (3), supporting structures (4), a flip cover (5), and lifting openings (6), wherein the cloth frame (2) is fixed on the hard base (1), the positioning frame (3) is fixed at a cloth frame opening of the cloth frame (2), four supporting structures (4) are arranged between the hard base (1) and the positioning frame (3), the flip cover (5) is sewn on one side on the cloth frame (2), and the lifting openings (6) are arranged on left and right ends of the cloth frame (2).

2. The supporting and locking structure for a cloth frame of claim 1, wherein the cloth frame (2) is designed with a soft structure, loop fasteners (21) are sewn at four corners on an upper inner side of the cloth frame (2), protective belts (22) are sewn at four corners that are located on the hard base (1) under the cloth frame (2), and hook fasteners (221) are arranged on one end of the protective belts (22) and stuck to the four loop fasteners (21) on the upper inner side of the cloth frame (2).

3. The supporting and locking structure for a cloth frame of claim 1, wherein the positioning frame (3) consists of a positioning subframe (31) and a positioning parent frame (32), a locking convex edge (311) on an outer side of the positioning subframe (31) is fixedly connected to edges of a cloth frame opening of the cloth frame (2) through a sewing machine, a plurality of locking grooves (312) are arranged on a convex wall on an inner side of the positioning subframe (31), locking barbs (313) are fixed in the locking grooves (312) and fixedly connected to a plurality of positioning grooves (321) on an inner side at a bottom portion of the positioning parent frame (32), the locking convex edge (311) on the outer side of the positioning subframe (31) is clamped in the locking grooves (322) at a lower portion of the positioning parent frame (32), while the locking barbs (313) are clamped and fixed in the positioning grooves (321), a flip cover positioning groove (323) is arranged on the positioning parent frame 32, and the flip cover 5 is just clamped in the flip cover positioning groove (323) when it is locked.

4. The supporting and locking structure for a cloth frame of claim 1, wherein the supporting structures 4 each consist of a first supporting leg (41), a second supporting leg (42), a first protective sleeve (43), a second protective sleeve (44), a positioning sleeve (45), and an elastic band (46), the first supporting leg (41) and the second supporting leg (42) are designed with hollow structures, the first supporting leg (41) and the second supporting leg (42) have supporting portions, on which the first protective sleeve (43) and the second protective sleeve (44) are fixed, the positioning sleeve (45) is fixed on the first supporting leg (41), and the elastic band (46) is fixed between the first supporting leg (41) and the second supporting leg (42).

5. The supporting and locking structure for a cloth frame of claim 1, wherein the supporting structures (4) each have an upper end and a lower end that abut against the hard base (1) on an inner side of the cloth frame (2) and a positioning frame bottom (314) of the positioning subframe (31) through the first protective sleeve (43) and the second protective sleeve (44), respectively.

* * * * *